United States Patent [19]

Molinazzi

[11] Patent Number: 4,798,030

[45] Date of Patent: Jan. 17, 1989

[54] MODULAR SUPPORT FOR STAIRCASE STEPS

[75] Inventor: Roberto Molinazzi, Bologna, Italy

[73] Assignee: Indexstudio S.a.s. di Molinazzi Roberto & C., San Lazzaro Di Savena Bo, Italy

[21] Appl. No.: 49,362

[22] Filed: May 14, 1987

[30] Foreign Application Priority Data

Oct. 16, 1986 [IT] Italy ..... 3542 A/86

[51] Int. Cl.[4] ..... E04F 11/02

[52] U.S. Cl. ..... 52/188; 182/178; 182/228

[58] Field of Search ..... 182/178, 228; 52/182-188

[56] References Cited

U.S. PATENT DOCUMENTS

| | | | |
|---|---|---|---|
| 3,474,882 | 10/1969 | Ernst | 52/182 |
| 4,516,367 | 5/1985 | Molinazzi | 52/182 |
| 4,557,085 | 12/1985 | Yamazaki | 52/182 |
| 4,619,084 | 10/1986 | Snitman | 52/187 |

FOREIGN PATENT DOCUMENTS

| | | | |
|---|---|---|---|
| 600092 | 1/1976 | Switzerland | 52/183 |

*Primary Examiner*—James L. Ridgill, Jr.

*Attorney, Agent, or Firm*—Guido Modiano; Albert Josif

[57] ABSTRACT

The modular support for staircase steps comprises a substantially vertical box-like body upwardly defining a horizontal base plane for a related step, a male cylindrical element and a complementarily shaped female cylindrical element extending vertically at two different levels at the opposite longitudinal ends of said box-like body and adapted to be coupled in an angularly adjustable position to corresponding cylindrical elements of adjacent supports, said male cylindrical element being less extended vertically with respect to said female cylindrical element so as to allow an adjustment of the mutual axial position by means of the insertion of suitable spacer means, substantially axial means along finally provided for the locking of said coupled cylindrical elements.

3 Claims, 5 Drawing Sheets

MODULAR SUPPORT FOR STAIRCASE STEPS

BACKGROUND OF THE INVENTION

The present invention relates to a modular support for staircase steps.

So-called independent structure staircases are known, the flights whereof consist of a slab supporting the steps, rigidly coupled at the ends to the landings to be connected. This slab is advantageously modular by means of a series of step supports: said supports allow both to vary the path of the axis of the flight and to adjust the step rise.

The supports currently in use substantially define a pair of small vertical sleeves spaced from one another and arranged at different heights, so as to be able to respectively couple to the corresponding sleeves of the adjacent supports, in the desired axial and angular position. The mutual locking of the supports is obtained by means of suitable screw means, which are generally required not to be visible due to aesthetical reasons.

This requirement usually causes the positioning and the locking of conventional modular supports to be difficult, so that the installation of the staircase is complicated and expensive. To this it must be added the fact that, at the ends of the staircase, additional elements are required for connection to the landings, often having a number of parts and thus further complicating the construction and the installation of the structure.

SUMMARY OF THE INVENTION

The aim of the present invention is to eliminate the above described disadvantage by providing a modular support which allows to easily assemble the steps of the flight, adjusting the mutual axial and angular position thereof as required.

Within the scope of this aim, a further object of the invention is to provide a modular support for staircase steps simple in structure, easy to build, versatile in use and reliable, as well as of proper appearance.

This aim and this object are both achieved, according to the invention, by the present modular support for staircase steps, comprising a substantially vertical box-like body upwardly shaping a horizontal base plane for a related step, a male cylindrical element and a complementarily shaped female cylindrical element which extend vertically at two different levels at the opposite longitudinal ends of said box-like body and are adapted to be coupled in an angularly adjustable position to corresponding cylindrical elements of adjacent supports, said male cylindrical element being less extended vertically with respect to said female cylindrical element so as to allow the adjustment of the mutual axial position by means of the insertion of suitable spacer means, substantially axial means being finally provided for the locking of said coupled cylindrical elements.

BRIEF DESCRIPTION OF THE DRAWINGS

The details of the invention will become apparent from the detailed description of a preferred embodiment of the modular support for staircase steps, illustrated only by way of non-limitative example in the accompanying drawing, where.

DESCRIPTION OF THE PREFERRED EMBODIMENTS

Figure 1:
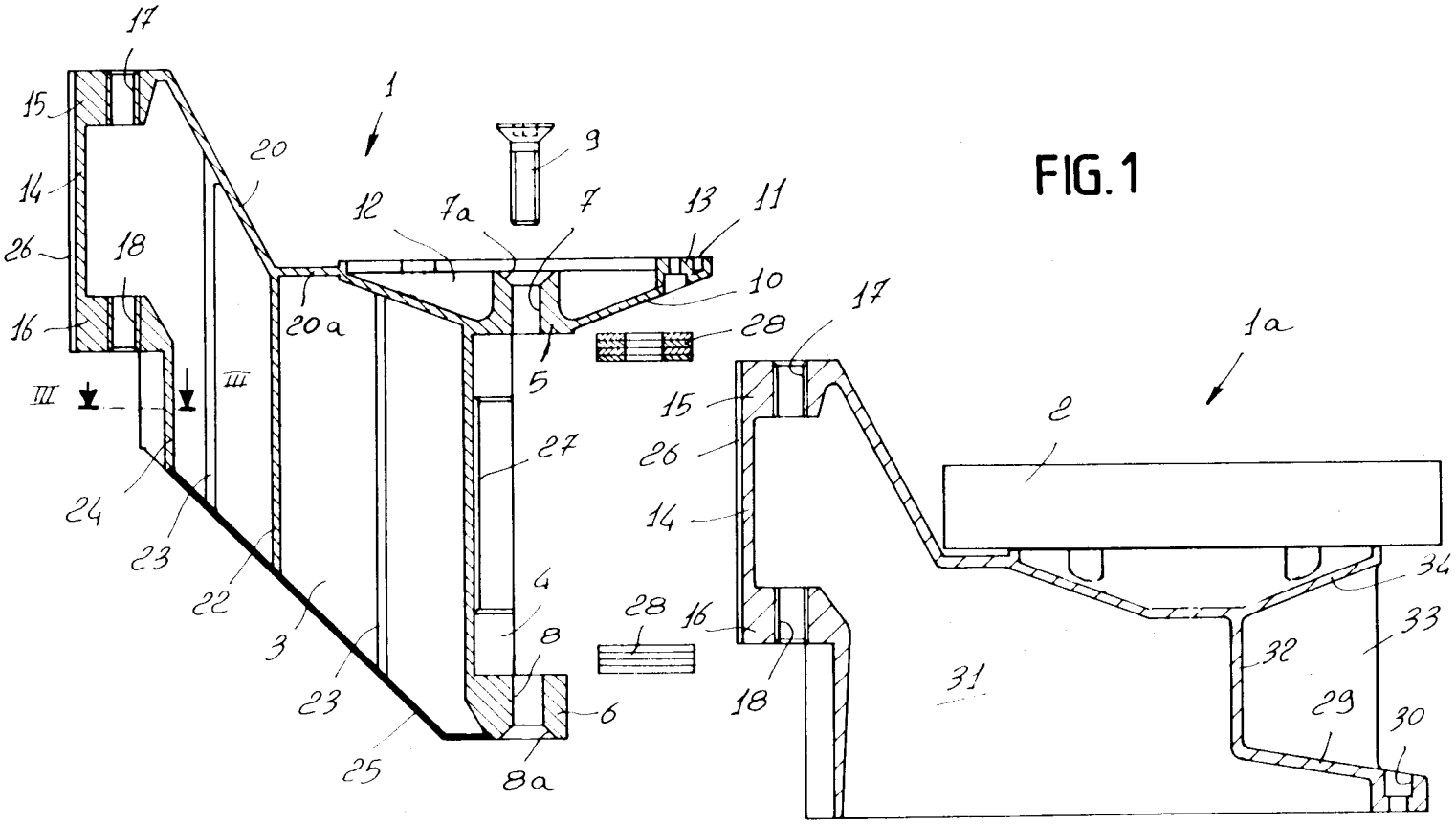
FIG. 1 is a partially exploded vertical cross section view of a modular support, detailing its coupling to the lower element of the flight of stairs.
Figure 2:
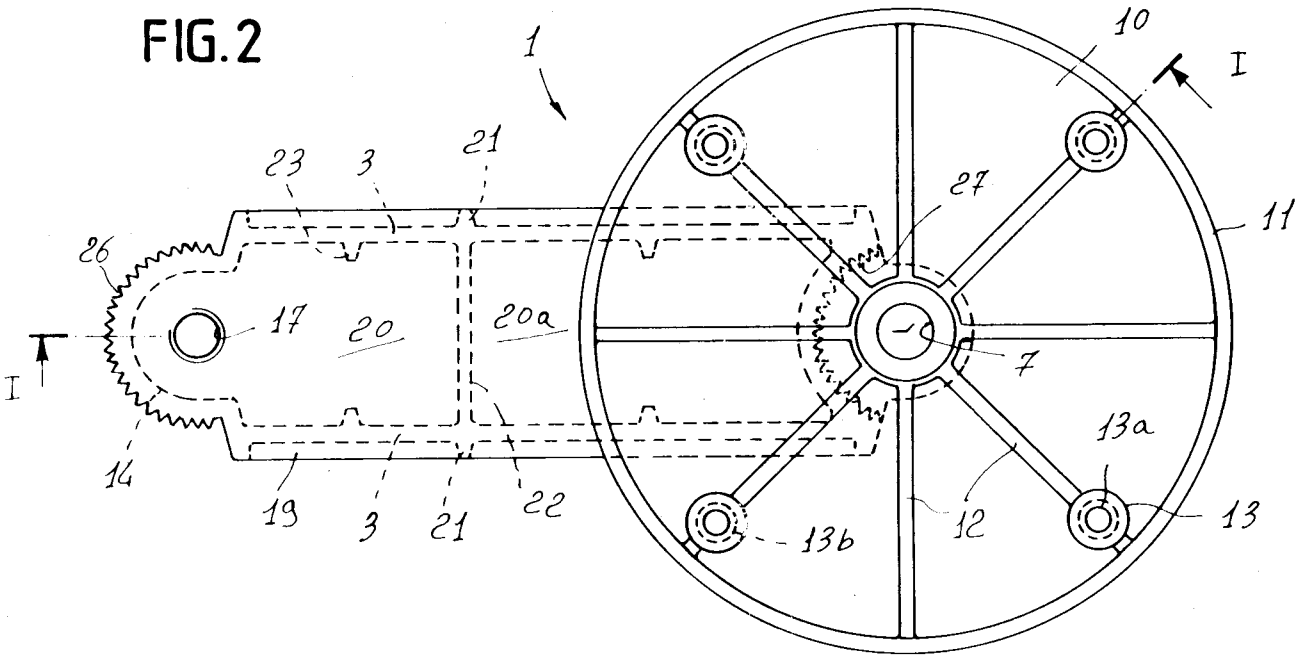
FIG. 2 is a top view of the support.

With reference to the cited figures, the reference numeral 1 generally indicates a modular support, according to the invention, for the steps 2 of a flight of stairs with independent structure. The support 1 defines a substantially vertical box-like body in which a pair of lateral walls 3 can be seen. The walls 3 extend from the borders of a vertical cylindrical portion 4 arranged frontally with respect to the support and having a concavity facing outwards.

The cylindrical portion 4 has, at its ends, a projecting upper headpiece 5 and a projecting lower headpiece 8 cylindrical in shape, provided, respectively, with through holes 7, 8 coaxial to said cylindrical portions. Respective screws 9 insert into the holes 7,8, to lock the underlying support of the flight of stairs, as described hereinafter. The holes 7, 8 are provided, respectively at the upper and lower end, with countersinkings 7*a*, 8*a* for the accommodation of the head of said screws.

The upper headpiece 5 defines the bottom of a circular plate 10 having an upward concavity and an annular edge 11 defining the base plane of a related step 2. The headpiece 5 extends in the shape of a hub inside the plate 10 and a plurality of ridges 12 extends radially therefrom for the stiffening of said plate. At said ridges, inside the plate 10 vertical sleeves 13 are provided for the coupling of the step 2, by means of suitable screw means. The sleeves 13 are conveniently distributed angularly at 90° to one another and are downwardly provided with an inner widening 13*a* for the head of said screw means. The headpiece 5 and the ridges 12 extend to the level of the lower border of the edge 11 of the plate, the sleeves 13 instead extend up to the upper border thereof.

At the longitudinal end of said box-like body opposite with respect to the cylindrical portion 4, the walls 3 connect to a vertical cylindrical element 14 which extends above the base plane of the step and is complementarily shaped to the inner surface of the cylindrical portion 4. More in particular, the cylinder 14 extends for a height suitably smaller than that of the cylindrical portion 4, starting from a plane arranged substantially at the level of the lower border of the headpiece 5. The cylinder 14 is hollow and has an upper headpiece 15 and a lower headpiece 16 axially provided respectively with holes 17, 18.

The lateral walls 3 have the upper and lower edges inclined upwards in the direction of ascent of the staircase, and are surrounded on the outer faces by a perimetral ridge 19. Along the upper edge, said walls are joined by a small wall 20 having a horizontal portion 20*a* adjacent to the plate 10 and inclined for the remaining portion until it joins to the top of the cylinder 14. Starting from the edge defined by said horizontal portion 20*a* of the small upper wall 20, the outer face of the walls 3 is provided with a vertical ridge 21: at the vertical plane defined by said ridges 21, the walls 3 are internally joined by a transverse connecting wall 22. Further vertical ridges 23 are provided on the inner face of the walls 3. The lower edge of the walls, instead, ends substantially below the cylinder 14 and is connected thereto by a vertical edge delimiting a portion 3*a* of said walls external to a further connecting wall 24; the connecting wall 24 extends below the head 16 of the cylinder.

The support is closed below by a cover 25 shaped according to the profile of the lower edge of the walls 3. The cylinder 14 is provided on the outer surface with a set of vertical teeth 26 having a triangular profile; conveniently said teeth are angularly offset by 7° 30″ with respect to one another. The set of teeth 26 is adapted to couple with a corresponding vertical set of teeth 27 provided in the central region of the cylindrical portion 4. The cylinder 14 and the cylindrical portion 4 thus constitute respectively the male and female elements whereby each support can be coupled, in the desired angular position, to the overlying and underlying supports of the flight of stairs. Naturally the adjustment of the mutual angle occurs in steps equal to the angle between one tooth and the next.

Vice versa, for the adjustment of the rise between the relted steps, between the cylinder 14 and the upper headpiece 5 and lower headpiece 6 of the cylinder portion, annular spacers 28 can be inserted, and adapted to compensate the different height of said cylinder and of said cylindrical portion. As can be clearly understood, by increasing the number of spacers arranged below the cylinder (and obviously correspondingly reducing the number of the ones arranged above) the steps are moved closer, and vice versa. Advantageously the spacers 28 have an external diameter corresponding to the diameter of the cylinder 14.

Once the desired axial and angular position of the two supports has been set, they are locked by means of the screws 9 engaging the holes 7, 8 of the headpieces 5, 6 of one support and lock in the coaxial threaded holes 17, 18 of the headpieces 15, 16 of the other. It is possible, in this manner, to provide flights of steps the axis whereof follows any path, if required even with variable geometry, and with the desired riser between one step and the next.

Figure 3:
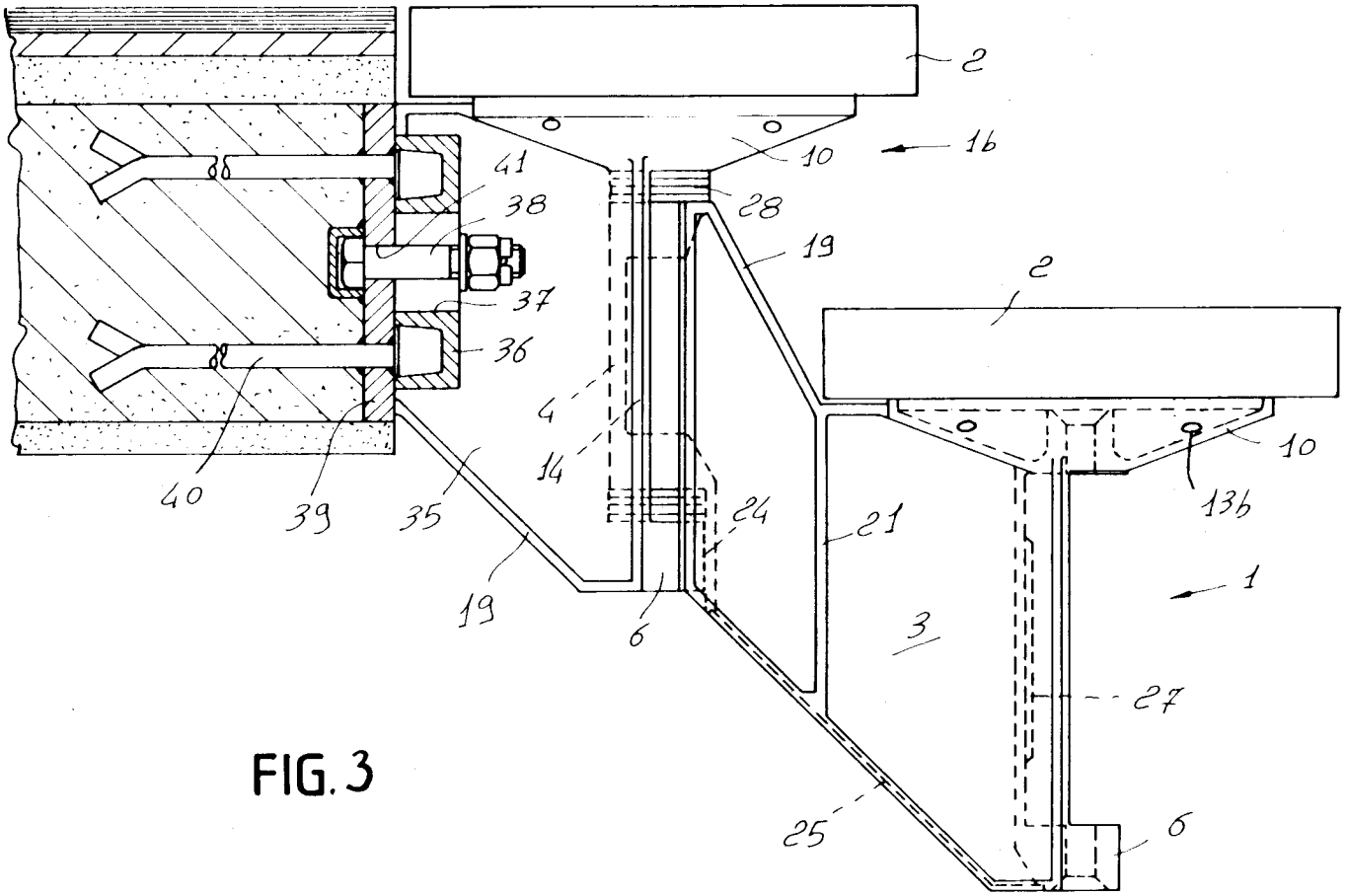
FIG. 3 is a lateral elevation view of the upper part of the flight of stairs according to the invention.

In order to make the flight of steps rigidly coupled to the slabs of the landings, supports are provided for the lower step and for the upper step, indicated respectively by 1*a* and 1*b* and illustrated in FIGS. 1 and 3. The support 1*a* for the lower step has a base plate 29 with holes 30 for coupling to the landing. A pair of vertical walls 31, similar to the walls 3 of the supports 1, extends from the plate 29 and connect in particular to an identical cylinder 14 for coupling to the adjacent support. On the opposite side, the walls 31 connect to one another along a cylindrical surface 32 outwardly provided with radial stiffening fins 33. Above the cylindrical surface 32, the bottom of a plate 34 is defined for the resting of the step, similar to the preceding plates 10.

The support 1*b* for the upper step of the staircase is provided with a pair of vertical walls 35 which, similarly to the walls 3 of the supports 1, extends from a related cylindrical portion 4 for coupling to the cylinder 14 of the underlying support. The walls 35 have a width limited in practice to the region underlying the plate 10 and are rigidly coupled to a plate 36 vertically transverse with respect to is provided, at the sides of the walls 35, with a pair of vertical slots 37 for bolts 38 for fixing to a further plate 39 secured by means of anchor rods 40 to the slab of the landing. Said further plate 39 is provided with corresponding horizontal slots 41 which are traversed by the bolts 38. By means of the slots 37 and 41, it is thus possible to adjust the position of mutual coupling of the plates 36 and 39 as desired.

Figure 4:
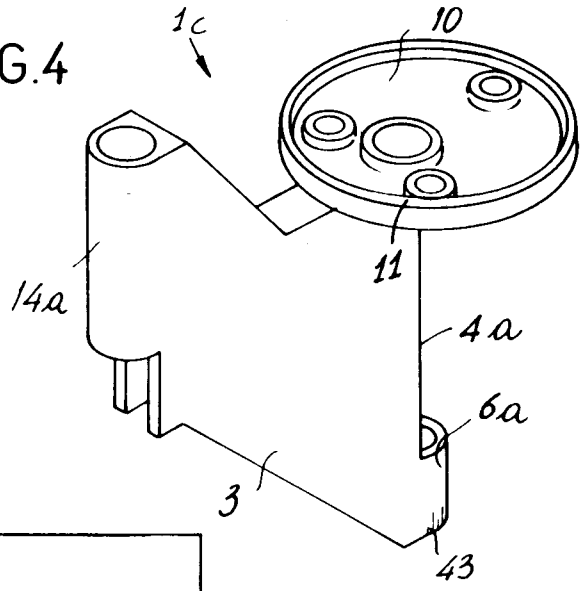
FIG. 4 is a perspective view of a support according to another aspect of the invention.
Figure 5:
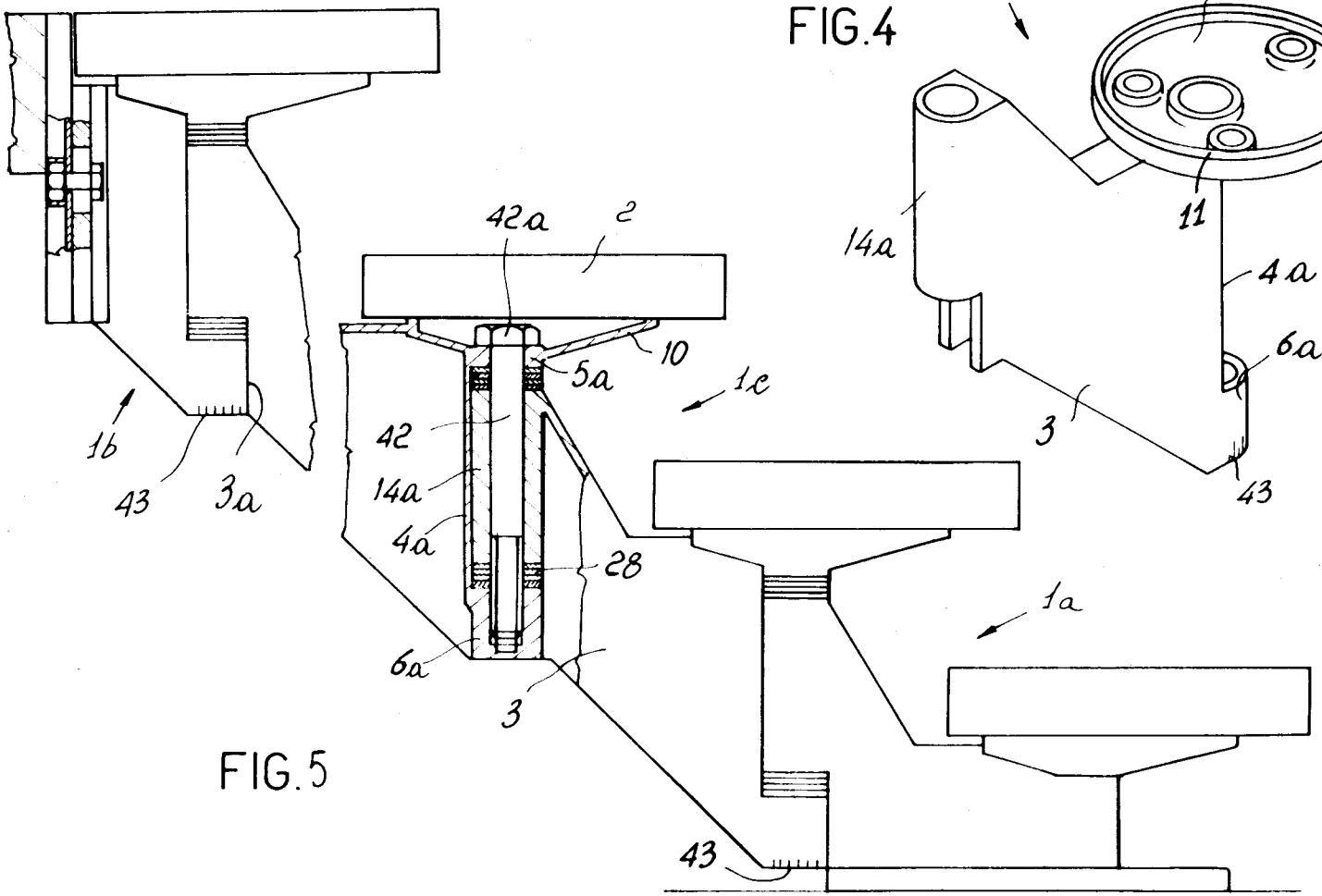
FIG. 5 is a vertical cross section view of a flight of stairs provided by means of the support of FIG. 4.

In FIGS. 4 and 5, the reference numeral 1*c* indicates a support according to another aspect of the invention; this support is provided, at the opposite longitudinal ends, with cylindrical elements male 14*a* and female 4*a* having the related cylindrical surfaces devoid of teeth. These male and female elements thus allow a continuous adjustment of the angular position of the support with respect to the adjacent supports, the coupling occurring on the cylindrical surface of said respective elements.

The male element 14*a* consists of a sleeve which has a cylindrical surface tangent in diametrally opposite positions to the lateral walls 3: similarly, on the opposite side, the upper headpiece 5*a* and the lower headpiece 6*a* of the female element 4*a* have a cylindrical shape tangent in diametrically opposite positions to said walls 3. For the coupling of said male element to the female element of the adjacent support, a screw element 42 is provided which is adapted to pass through said sleeve, inserting itself through the upper headpiece 5, so as to upwardly abut, at its head 42*a*, with said headpiece, and screwing itself into the lower headpiece 6. Advantageously, to facilitate during assembly the exact angular positioning of the supports to be coupled, a series of graduations 43 is provided at the lower edge of the headpiece 6*a* of each support. The vertical edge of the corner 3*a* of the lateral walls of the underlying support refers to said graduations.

Figure 7:
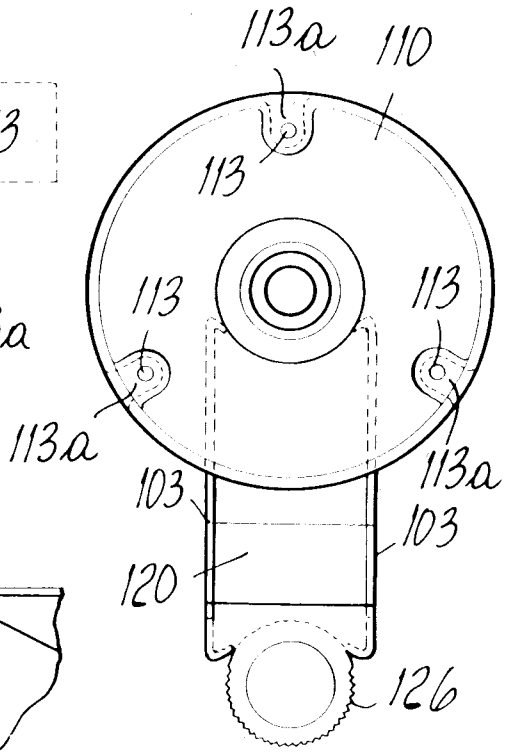
FIG. 7 is a top view of the support of FIG. 6.
Figure 6:
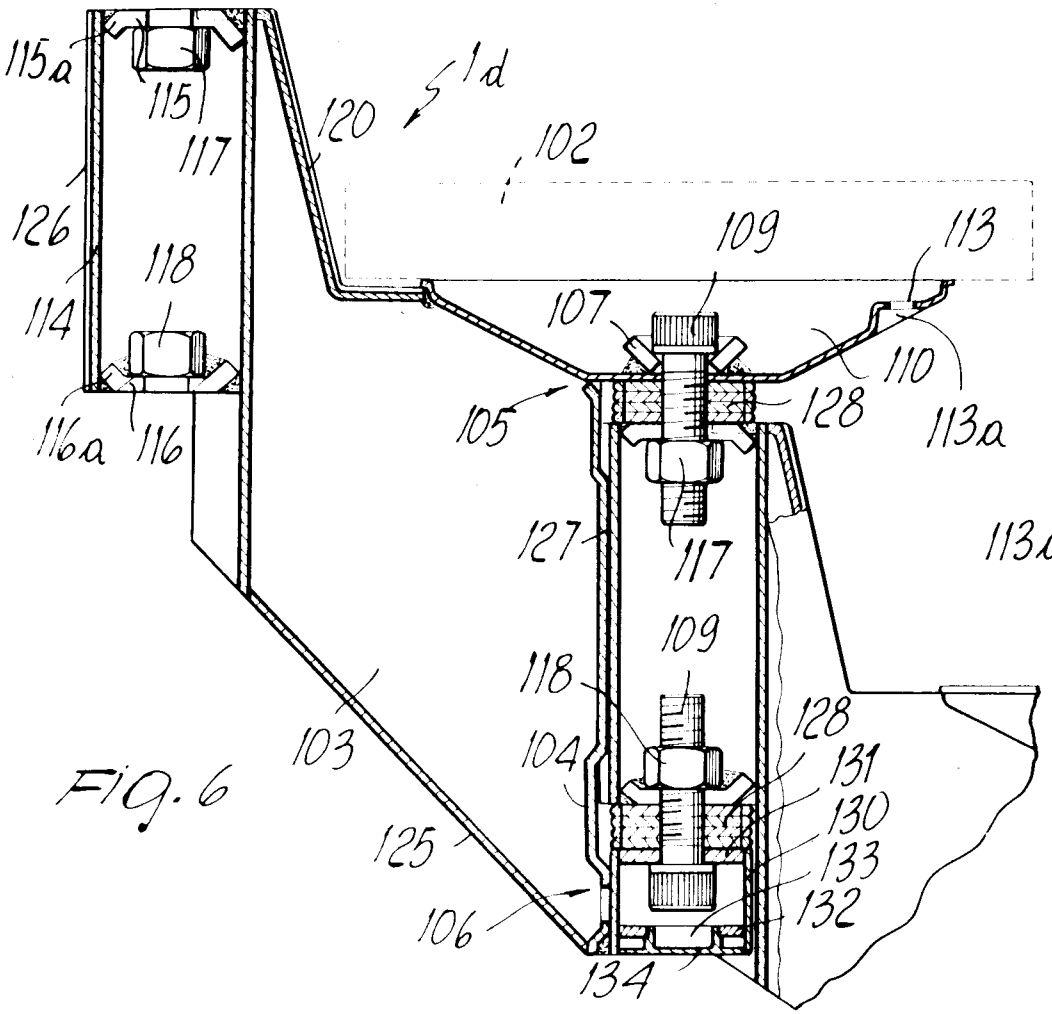
FIG. 6 is a vertical cross section view of part of a flight of stairs provided by means of a support according to a further aspect of the invention.

In FIGS. 6–7, a support 1*d* is illustrated, according to a further embodiment of the invention, preferably made of cut and welded metal plate. The support 1*d* comprises the walls 103 connecting the cylindrical elements, male 114 and female 104, arranged at its longitudinal ends; moreover, an upper wall 120 and a lower wall 125 close the space comprised between the walls 3.

The cylindrical element 114 is provided, on the outer surface, with a set of teeth 126 adapted to engage with a related set of teeth 127 provied in the central region of the cylindrical element 104 so as to provide a variable-angle coupling between the various supports, similarly to what has been described above.

The cylindrical element 104 is furthermore provided with an upper headpiece 105 and with a lower headpiece 106 which support the coupling means to the cylindrical element 114 of an adjacent support.

The upper headpiece 105 is essentially constituted by a plate 110 having a hole surrounded by a welded washer 107, for the accommodation of the coupling screw 109.

The plate 110 is furthermore provided with holes 113 located in suitable seats 113*a* and engaging with screw means for the fixing of a step 102.

The lower headpiece 106 comprises a sleeve 130 fixed to the lower end of the cylindrical element 104 and having an upper face 131 drilled for the accommodation of a coupling screw 109. The sleeve 130 is furthermore provided with a lower face 132 with a hole 133 to allow the insertion of the screw 109. Advantageously, a small cover 134 is placed at the lower face 132, in a snap-together manner, to hide from sight the screw 109 once the coupling has been performed.

The screws 109 engage with related nuts, upper 117 and lower 118, fixed to the cylindrical element 114.

The nuts 117 and 118 are located inside the cylindrical element and are advantageously welded respectively to the washers 115 and 116, in turn welded to the cylindrical element 114 at the opposite sides. The washers 115 and 116 are each provided with lowered portions, respectively 115*a* and 116*a*, to avoid any interference with the set of teeth 127 of the adjacent support.

In this case too, annular spacers 128 are provided to adjust the rise between the steps in a manner fully similar to what has been described above.

To conclude, the modular support described provides a simple and rapid way to build flights of stairs according to any required geometry. It is furthermore easy to manufacture, since, for example, it can be made monolithically by casting. Only two additional coupling elements to the end landings are required.

It should be stressed that, in the assembled condition, the supports form a continuous container with a proper appearance which encloses the related coupling elements, so that the application of coverings is not required.

In the practical embodiment of the invention, the materials employed, the dimensions and the shapes may be any according to the requirements.

We claim:

1. Modular support for staircase steps, comprising a box-like body, a female cylindrical portion provided at one end of said box-like body and defining a concavity facing outwards with respect to said body, a male cylindrical element provided at the opposite end of said body at a higher level with respect to said female portion, said female portion and said male element being vertically parallel to each other, a first headpiece projecting from the upper end of said female portion and provided with means for mounting a step thereon, a second headpiece projecting from the lower end of said female portion, vertical tooth means projecting outwards from said male element and inwards from said female portion, the tooth means of the male element being complementary to the tooth means of the female portion, screw means being further provided traversing said headpieces and adapted to engage a male cylindrical element of an adjacent support inserted into said concavity between said headpieces to retain the tooth means of said element in engagement relationship with the tooth means of said female cylindrical portion.

2. Modular support as claimed in claim 1 wherein said head pieces are provided with through holes coaxial to said cylindrical portion and said screw means traverses said holes and engages at the opposite ends a male element of an adjacent support.

3. Modular support as claimed in claim 1 wherein said male cylindrical element has an axial extension which is smaller than that of said concavity, spacer means being arranged between the opposite ends of a male element of an adjacent support inserted into said concavity and the lower and upper headpieces to adjust the mutual position of the supports.

* * * * *